United States Patent [19]

Fidi et al.

[11] 4,453,046

[45] Jun. 5, 1984

[54] ELASTIC SUPPORT FOR ELECTROACOUSTIC TRANSDUCERS

[75] Inventors: Werner Fidi, Baden; Konrad Wolf, Bad Vöslau, both of Austria

[73] Assignee: AKG Akustische u.Kino-geräte gesellschaft m.b.H., Austria

[21] Appl. No.: 418,980

[22] Filed: Sep. 16, 1982

[30] Foreign Application Priority Data

Sep. 24, 1981 [AT] Austria ..... 4104/81

[51] Int. Cl.[3] ..... H04R 13/04

[52] U.S. Cl. ..... 179/146 R; 179/180

[58] Field of Search ..... 179/146 R, 178, 179, 179/180, 184

[56] References Cited

U.S. PATENT DOCUMENTS

| | | | |
|---|---|---|---|
| 3,692,264 | 9/1972 | Burkhard | 179/146 R |
| 3,766,333 | 10/1973 | Watson | 179/146 R |
| 3,947,646 | 3/1976 | Saito | 179/146 R |

FOREIGN PATENT DOCUMENTS

| | | | |
|---|---|---|---|
| 1193104 | 5/1965 | Fed. Rep. of Germany | 179/146 R |

*Primary Examiner*—Harold I. Pitts
*Assistant Examiner*—L. C. Schroeder
*Attorney, Agent, or Firm*—McGlew and Tuttle

[57] ABSTRACT

A mounting for an electroacoustic transducer particularly those having a cardioid directivity characteristic and which has one face with a sound opening and an opposite face comprises a cylindrical housing for the transducer with a first tapered elastic support permeable to sound being provided in the sound path from the sound opening the transducer to one end of the housing and which has a narrow end engaged with the housing and an opposite widened end engaging the transducer from one face side at the rim of the sound opening. A second tapered elastic support permeable to sound has one end engaging the transducer from the opposite face and has an opposite end engaged with the housing.

7 Claims, 3 Drawing Figures

ELASTIC SUPPORT FOR ELECTROACOUSTIC TRANSDUCERS

FIELD AND BACKGROUND OF THE INVENTION

This invention relates in general to electroacoustic transducers and in particular to a new and useful mounting for said transducer.

The purpose of an elastic support of an electroacoustic transducer, such as of the electrostatic or electrodynamic type, in a surrounding housing is to prevent sound conducted through solids, vibrations, shocks, and impacts, from producing a direct effect on the transducer, and to protect the transducer from mechanical damages under extraordinary shocks caused by hitting or falling on a hard body. Due to the elastic fixation of its diaphragm, every electroacoustic transducer represents a mechanical oscillatory system taking up not only sound but also any disturbance imparted thereto which is then delivered as an electrical signal to the amplifier and reproduced as a noise. The elastic support acts as a mechanical filter by which, with a proper dimensioning, the disturbing energy is dissipated to the largest extent.

It is further known that in microphones having a uni-directional space pattern, a sound path must be provided from the front side to the rear side of the diaphragm of the electroacoustic transducer, which must not later be changed or otherwise incluenced if the transducer is to have the provided optimum characteristic. This is to be observed particularly if a shockproof mounting of the transducer or transducer capsule in a housing is provided. In prior art designs, this requirement is not met since the elements of conventional elastic supports on one side embrace the cylindrical surface of the transducer and on the other side, are secured to the inside of the housing in a manner impermeable to sound. Even with a housing permeable to sound, this notably extends the sound path from the front side to the rear side of the diaphragm, so that conditions under which the transducer shows its best directional performance are not satisfied. Consequently, the directional pattern is deformed and the directional effect is impaired.

SUMMARY OF THE INVENTION

The invention is directed to an elastic support in which rhe component parts are so arranged and designed that the passage of sound from the front side to the rear side of the transducer diaphragm is not hindered and the sound path is not altered.

In accordance with the invention a mounting for an electroacoustic transducer particularly of a type which has a cardioid directivity characteristic comprises a cylindrical housing for the transducer with a first tapered elastic support permeable to sound provided in the housing between the sound path from the sound opening to one end of the housing and which has narrow end engaged with the housing and an opposite wide end engaging the transducer from the one face side at the rim of the sound opening. A second tapered elastic support permeable to sound has one end engaging the transducer from the opposite face and has an opposite end engaged with the housing.

The advantage of this design is that with the transducer mounted within the housing, the directional characteristic of the transducer is preserved. In addition, the inventive design makes it possible to reduce the diameter of the housing accommodating the transducer, as compared to diameters of conventional design, since the supports of the transducer being provided at the two front faces of the transducer do not extend laterally. This may facilitate an inconspicuous placing of a microphone.

It is advantageous to provide the support element provided in the front of the sound opening with a web-shaped construction with a plurality of circumferentially spaced webs forming a truncated cone. Such an arrangement ensures a virtually unimpeded sound passage and an optimum elastic connection between the transducer and the housing. The support is advantageously made of an electrically conducting material such as a silicone rubber made conductive. Such a construction saves wire or stranded wire connections between the transducer and the housing.

Preferably both supports are made of an electrically conducting material with a frequency dependent sound absorption which is higher at low frequencies than at high frequencies. Such a material for example, may be a butyl rubber or a bromobutyl rubber.

The arrangement effects a correspondingly stronger sound absorption in the low frequencies and a throughout satisfactory insulation against sound transmission through solids in the lower audibility range between 16 Hz and 100 Hz, provided that the resonant frequency of the oscillatory system formed by the mass of the electroacoustic transducer and the elastic support is also selected in the range of 16 to 100 Hz. The advantage of a frequency-dependent sound absorption is that, in addition to eliminating the necessity of fixing the electroacoustic transducer for extremely low frequencies below the audibility range, electrical filters for suppressing the lowest-frequency noises can be omitted. As is well known in general, a satisfactory insulation against sound transmission through solids can be obtained only with supports mounted for a critical frequency higher than $\sqrt{2}$ fold the resonance frequency. The material for an elastic mounting with a frequency-dependent sound absorption must be of such nature that the absorption is very high for low frequencies but decreases with the increasing frequency.

The inventive elastic support may also be used for electrodynamic transducers. Quite generally, with identical geometric dimensions, electrodynamic transducers are heavier than electrostatic ones, wherefore they require another dimensioning of the elastic material. In many instances, the lower frequency limit of the transmission range is not as low as in electrostatic transducers so that the frequency dependent sound absorption may not be absolutely necessecary since an effective insulation against sound transmission through solids is possible by providing a mounting for above the critical $\sqrt{2}$ fold resonance frequency.

Accordingly, it is an object of the invention to provide an improved mounting for a transducer in a housing of cylindrical characteristic which includes a support engaging the transducer from respective opposite sides and being in tapered shape tapering from the housing to the transducer at its respective ends and advantageously being made of conductive material having resiliency.

A further object of the invention is to providle a mounting for a transducer which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
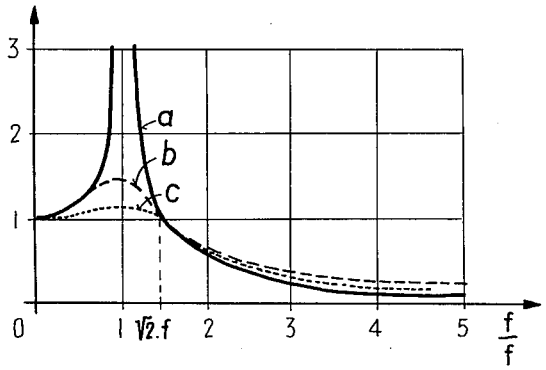
FIG. 1 is a diagram showing a curve of the force transmitted from the housing through an elastic support to the electroacoustic transducer plotted against the frequency.

Referring to the drawings in particular the invention embodied therein comprises a mounting for an electroacoustic transducer particularly transducers of a type which have a cardioid directivity generally designated 1 and has one face 1*a* with a sound opening and has an opposite face having a contact pin 6. The transducer is mounted in a cylindrical housing 3 and it is supported therein by a first tapered elastic support which is permeable to sound and is provided in the sound path from the sound opening to one end of the housing. The tapered elastic support has a narrow end engaged with the housing at the location of a cylindrical pin part 5 and an opposite widened end engaged with the transducer 1 from the one face side at the rims of the sound opening 1*a*. An additional or second tapered elastic support permeable to sound designated 7 has one end in the form of a sleeve 8 engaging the transducer 1 at the location of a contact pin part 6 which extends from the face opposite to the sound opening and an opposite end outwardly tapered from the first end which forms a sleeve 9 engaged around a contact part 10 mounted in an insulation in that end of the housing.

If an oscillatory system formed by the masses of the electroacoustic transducer and the elastic support is excited by an external force, the force acting on the transducer can be plotted in a diagram as a function of the frequency, as shown in FIG. 1. Curve a characterizes an undamped system, curve b a system damped in the usual manner, and curve c a system which is damped depending on the frequency. The diagram shows that with the use of a conventional elastic material, above the $\sqrt{2}$ fold resonance frequency, the force transmitted to the transducer no longer produces more than a small effect which corresponds to a satisfactory insulation against sound transmitted through solids. If it is desired to insulate the electroacoustic transducer against sound through solids, even below this $\sqrt{2}$ fold resonance frequency, the optimum solution is to use an elastic material absorbing sound as a function of the frequency (see curve c). Such a material preferably shows a maximum sound absorption for frequencies below the $\sqrt{2}$ fold resonance frequency, while for frequencies thereabove, they must show an absorption decreasing with the increasing frequency.

Figure 2:
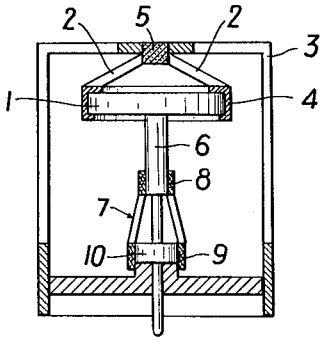
FIG. 2 is a diagrammatical sectional view of an electrostatic transducer constructed in accordance with the invention.

According to FIG. 2, an electroacoustic transducer 1, in this example an electrostatic one, carries on its front side a truncated cone 2 formed by narrow webs which are made of an elastomer and arranged around a speech aperture 1*a* of transducer 1. The housing 3 which is widely open-worked and well permeable to sound does not substantially affect the sound field. This provides preconditions for a minimum length of the sound path between the front side and the rear side of the diaphragm. Laterally of the speech aperture, transducer 1 is firmly embraced by a sleeve 4 which is locally glued to the transducer, to obtain a secure connection. Projecting from sleeve 4, are the webs 2, which form a truncated cone structure, the upper end of which embraces a cylindrical pin 5 which projects from the center of the front side of the housing toward the speech aperture 1*a*. A contact pin 6 projects centrally from the rear side of transducer 1. The pin 6 is embraced by a sleeve 8 of another support 7 again formed by elastic webs which may extend to form a conical or cylindrical structure. Another sleeve 9 embraces a contact part 10 which is centrally provided on the bottom of housing 3 and insulated. Sleeves 8 and 9 also are locally glued to the parts they embrace. Elastic supports of this kind may serve at the same time as contacting elements for the transducer, provided that they are made of an electrically conducting material, such as silicone rubber, butyl rubber or bromobutyl rubber.

Figure 3:
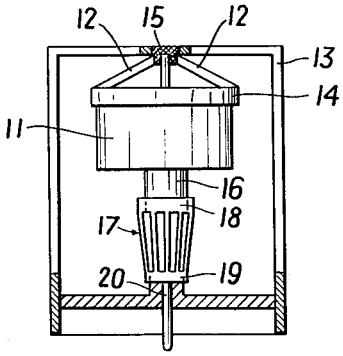
FIG. 3 is a view similar to FIG. 2 of another embodiment of the invention indicating an electrodynamic transducer.

FIG. 3 shows an embodiment for an electrodynamic transducer 11. The principal parts 12,14,15,17,18,19 of the elastic support are identical with those of the embodiment of FIG. 2. Because of the greater weight and dimensions of the electrodynamic transducer 11 as compared to an electrostatic one, the two supports 12 and 17 must be stronger, i.e. have larger dimensions. Transducer 11 again may be connected to a housing 13 and a contact part 20 through the elastic elements of the support, if these elements are made of an electrically conducting material. In a microphone equipped with the inventive elastic support, the unilateral directional pattern of the transducer accommodated in the housing remains unchanged i.e. as initially designed. The effect obtained with this construction is that the housing surrounding the transducer becomes substantially more slender, i.e. has a smaller diameter, than with the use of conventional elastic supports. This is due to the fact that the elements of the inventive supports do not embrace the transducer as a ring from all sides, as in the prior art, but have a diameter at most equal to that of the supported transducer.

While specific embodiments of the invention have been shown and described in detail to illustrate the application of the principles of the invention, it will be understood that the invention may be embodied otherwise without departing from such principles.

What is claimed is:

1. A mounting for an electroacoustic transducer paticularly a transducer having a cardioid directivity characteristic and having one face with a sound opening and an opposite face, comprising a cylindrical housing, a first tapered elastic support permeable to sound provided in the sound path from the sound opening to the adjacent end of said housing and having a narrow end engaged with said housing and an opposite widened end engaged with said transducer from the one face side at the rim of the sound opening, and a second tapered elastic support permeable to sound having one end engaging the transducer from the opposite face thereof and having an opposite end engaged with said housing.

2. A mounting according to claim 1, wherein at least a first support is made of substantially web-shaped configuration in the form of a truncated cone.

3. A mounting according to claim 1, wherein said at least one of said supports comprises an electrically conductive material such as a silicone rubber made conductive.

4. A mounting according to claim 1, wherein each of the supports are made of electrically conducting material having a frequency dependent sound absorption which is higher at low frequencies than at high frequencies.

5. A mounting according to claim 4, wherein said supports are one of the following; a butyl rubber, a bromobutyl rubber.

6. A mounting according to claim 1, including a contact pin extending outwardly from said opposite face of said transducer, said second tapered elastic support having one end engaged with said contact pin and having an opposite end which is wider than said first end engaged with said housing.

7. A mounting according to claim 5, wherein said housing has a contact part engaged with said opposite outer widened end of said second support.

* * * * *